US007055792B2

(12) United States Patent
Vappula

(10) Patent No.: US 7,055,792 B2
(45) Date of Patent: Jun. 6, 2006

(54) CLAMP DEVICE FOR SIDE WALL BEAMS

(75) Inventor: Kari Vappula, Toijala (FI)

(73) Assignee: Consolis Technology Oy AB, Vantaa (FI)

( * ) Notice: Subject to any disclaimer, the term of this patent is extended or adjusted under 35 U.S.C. 154(b) by 143 days.

(21) Appl. No.: 10/650,701

(22) Filed: Aug. 29, 2003

(65) Prior Publication Data

US 2004/0041075 A1 Mar. 4, 2004

(30) Foreign Application Priority Data

Sep. 2, 2002 (FI) ..... 20020360 U

(51) Int. Cl.
*B28B 7/00* (2006.01)

(52) U.S. Cl. ..... 249/166; 249/187.1; 249/219.1

(58) Field of Classification Search ..... 249/163, 249/165, 166, 187.1, 219.1
See application file for complete search history.

(56) References Cited

U.S. PATENT DOCUMENTS 1,272,281 A * 7/1918 McCord ..... 249/219.1
1,553,891 A * 9/1925 Cloud ..... 24/278
2,172,461 A * 9/1939 Whitescarver ..... 411/435
3,442,482 A * 5/1969 Preblich ..... 249/219.2
4,146,261 A 3/1979 Edmaier et al.
4,280,677 A * 7/1981 Shahar ..... 249/43

FOREIGN PATENT DOCUMENTS

| | | |
|---|---|---|
| FI | 4973 | 6/2001 |
| FR | 2 549 548 | 1/1985 |
| GB | 849200 | 9/1960 |

OTHER PUBLICATIONS

English abstract for FR 2 549 548.*
European Patent Office. European Search Report. Application No. EP 03 39 6076. The Hague. Jul. 15, 2005. 3 pages.

* cited by examiner

*Primary Examiner*—Donald Heckenberg
(74) *Attorney, Agent, or Firm*—Buchanan Ingersoll PC

(57) ABSTRACT

A clamp unit is for interconnecting side wall beams of a concrete casting mold. The side wall beams incorporate protruding upper and lower edges. The clamp unit (1) includes at least two end portions (2,3) connected to each other and members (4,5,6) for adjusting the distance between the end portions. The end portions are advantageously connected to each other so that a spring-force is provided for moving the end portions farther or closer to each other.

10 Claims, 5 Drawing Sheets

CLAMP DEVICE FOR SIDE WALL BEAMS

FIELD OF THE INVENTION

The present invention relates to interconnection of side wall beams of a concrete casting mold to each other. In particular, the invention relates to a clamp unit suitable for use in conjunction with a side wall profile having protruding upper and lower edge rails running along its rear side.

BACKGROUND OF THE INVENTION

Mold side wall beams are used, e.g., in casting concrete wall elements. Herein, the side wall beams are placed on a casting mold bed at desired locations determined by the size and shape of the object to be cast. Advantageously, the side wall beams are attached to the metallic casting bed by clamp magnets as described, e.g., in Finnish utility model application no. 4973. Side wall beams may also be employed for making openings, e.g. for window frames, at desired locations of the cast product. The casting machine travels above the casting bed and dispenses concrete mix into the mold delineated by the mold side walls. After the concrete is set, the side walls are detached. Elements are fabricated for different uses, whereby the dimensions of the products being cast, e.g., their length and width, as well as the size and number of possible openings, may vary widely.

A state-of-the-art solution for meeting the needs for continuously varying element dimensions is to prepare a separate mold for each different element size because no rapid and accurate method has been available for extending and interconnecting side wall beams. Due to the lack of reliably and rapidly dismountable mold constructions it has been necessary to make a release cant (i.e., slanted mold walls) in fixed-size molds used for making openings.

SUMMARY OF THE INVENTION

The invention relates to a clamp unit for extending and dismounting the side wall beams of a concrete casting mold. By virtue of the invention it is possible to accomplish a simple system for quick interconnection and/or dismounting of side wall beams.

The clamp unit according to the invention comprises at least two opposed end portions the distance between which at least in the plane of the rear side of the side wall beam can be adjusted and means for adjusting the distance between the end portions. In the interconnection of side wall beams to each other, the clamp unit is placed on the rear side of the beam at the joining point of the beam, in the space delineated by the protruding upper and lower edge rails. Herein, the distance between the end portions is advantageously adjusted such that the clamp device can easily be inserted into the said space. Therefore, there is no need to slide the clamp unit from the end of the side wall beam to the desired joining point of beams when the said lower and/or upper edge rails of the side wall beam form e.g., a groove together with the side wall beam rear side. In connection of interconnection of the side wall beams, the distance between the end portions is increased so much that the end portions will press against the outwardly protruding upper and lower edge rails of the side wall beam rear side, whereby at least part of the clamp unit will become wedged between the upper and lower edges of the mold side wall beams thus effecting the interconnection of the beams. Advantageously, the clamp unit comprises means for retaining the distance between the end portions as desired.

When side wall beams connected to each other by means of the clamp unit according to the invention are being disengaged from each other, the said distance between the end portions is decreased, whereby the press force exerted between the end portions and the said upper and lower edge rails decreased thus allowing easy removal of the clamp unit.

The clamp unit can be used for interconnecting, e.g., two side wall beams directly or so that there is a small connecting piece between the two side wall beams. The latter application also represents a case, wherein a single clamp unit may extend over more than one connection point. This kind of connection of a connecting piece to a side wall beam or to side wall beams is particularly advantageous when mold side walls are being assembled or dismounted in order to provide an opening in an element and is a significant improvement in the state of the art.

In an advantageous embodiment of the clamp unit according to the invention, between the end portions are adapted means or part of means for adjusting the distance between the end portions. In an advantageous embodiment of the invention, the said end portions are joined by a structure by moving which the end portions of the clamp device can be moved. The end portions may be separately attached to the structure or be an integral part of the structure. In an advantageous embodiment of the invention, the end portions are connected to each other or are in connection with each other so that a spring-force is provided for moving the end portions farther or closer to each other. In an advantageous embodiment, the said structure is advantageously plate-like and particularly advantageously is formed of an at least partially bent plate or e.g. of material that is pressed or shaped into a plate-like, partially bent form. In a preferred embodiment, the structure between the end portions is essentially U-shaped with the prongs of the U-shape advantageously being slanted. As a result, an empty space remains between the structure and the rear side of the beam. Into the empty space delineated by said structure is placed a intermediate part by moving which the distance between the opposed end portions can be adjusted. The said intermediate part can be an object having, e.g., a box-like shape, advantageously with at least one slanted side surface, and two opposite side surfaces thereof contacting at least partially the structure connecting the end portions. When the intermediate part is moved, advantageously substantially upwards or downwards, in a direction wherein the sides of the structure are closer to each other, the said sides of the structure are moving farther from each other and the said structure becomes wider in the plane of the rear side of the side wall beam, thus increasing the distance between the opposed end portions. Correspondingly, movement of the intermediate part in the opposite direction in regard to the direction mentioned above causes contraction of the structure and, the distance between the end portions decreases and the said structure will finally take substantially its original shape. Advantageously, the intermediate part is moved by means of or actuated by, e.g., a screw, spring or an eccentric cam mechanism 11, 12 (see FIGS. 1*b*, 1*c*), which moving member can also act as said member for keeping the distance between the end portions as desired. According to an advantageous embodiment of the invention, the means for adjusting the end-to-end distance of the end portions comprise a screw or a spring substantially in the horizontal plane.

Among others, the invention offers the following remarkable benefits:

side wall beams can be utilized in elements of different sizes by combining the beams as needed in each case;

the length of side wall beams can be rapidly and simply changed to meet new dimensions of the element to be cast;

in order to make openings to elements, no more stationary molds for openings are needed but side walls can rapidly and accurately be combined in order to accomplish a site for an opening of desired size;

dismounting a mold for an opening is notably simple and fast;

tight fastening allows also easy trimming of extendible profiles a the site;

the clamp unit is easy to mount in place without requiring any special preparations such as drilling or sliding along the grooves; and due to unlimited adjustment of the distance between the clamp unit end portions, the clamp unit can be used in side wall beams of different heights.

BRIEF DESCRIPTION OF THE DRAWING

Next, the invention will be examined in greater detail by making reference to the attached drawings, wherein.

DESCRIPTION OF THE PREFERRED EMBODIMENT

Figure 1A:
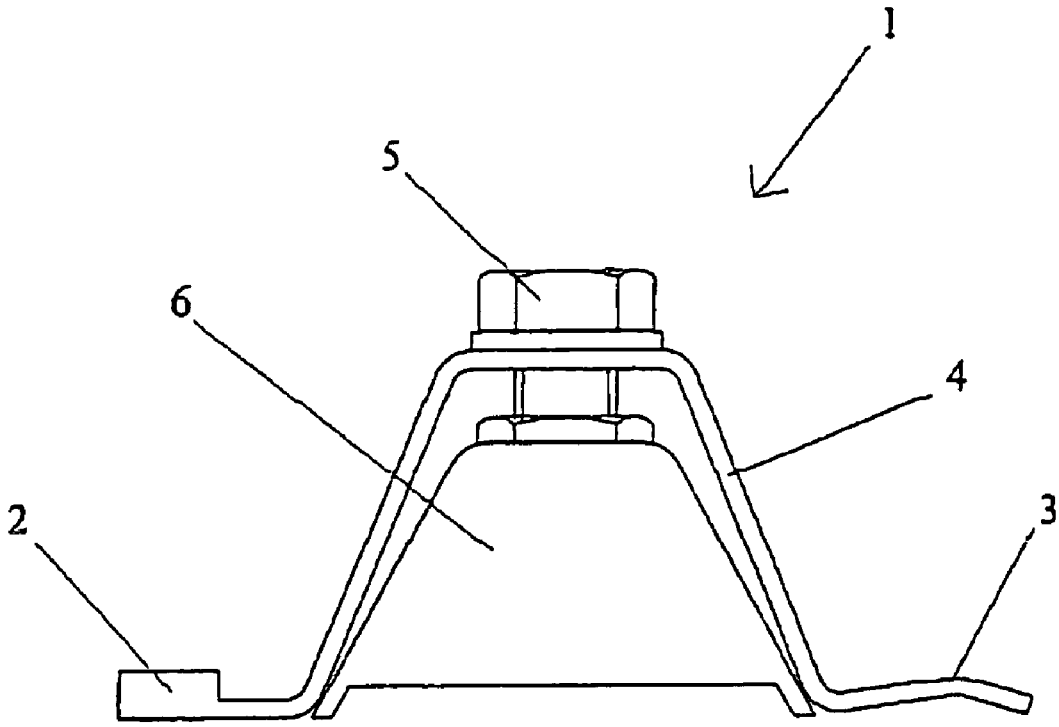
FIG. 1*a*–1*c* show side views of a clamp unit and eccentric cam mechanism according to the invention.
Figure 1C:
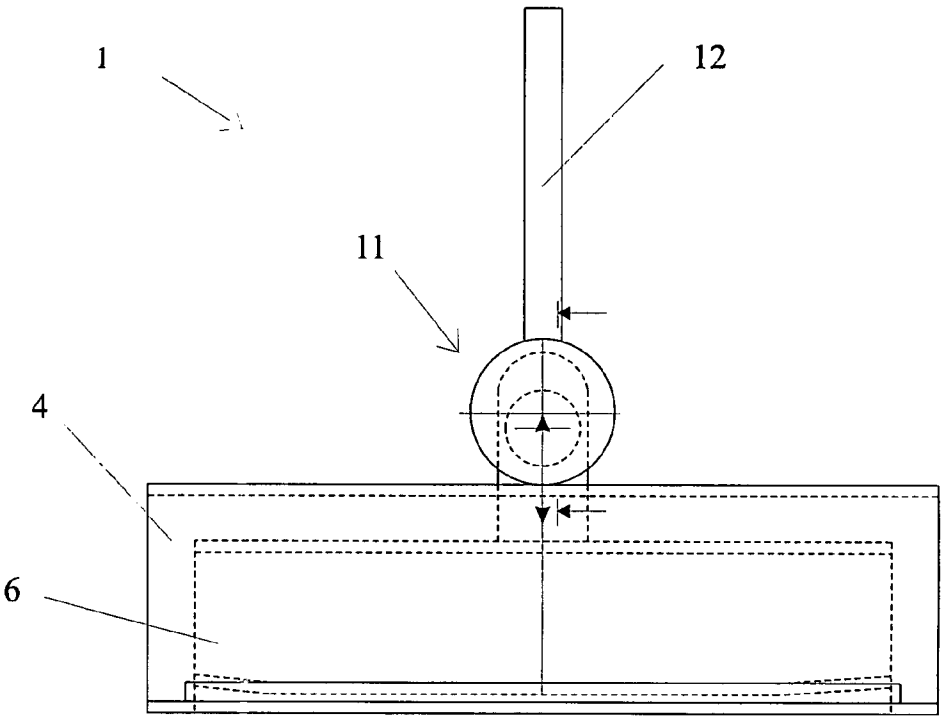
Figure 1B:
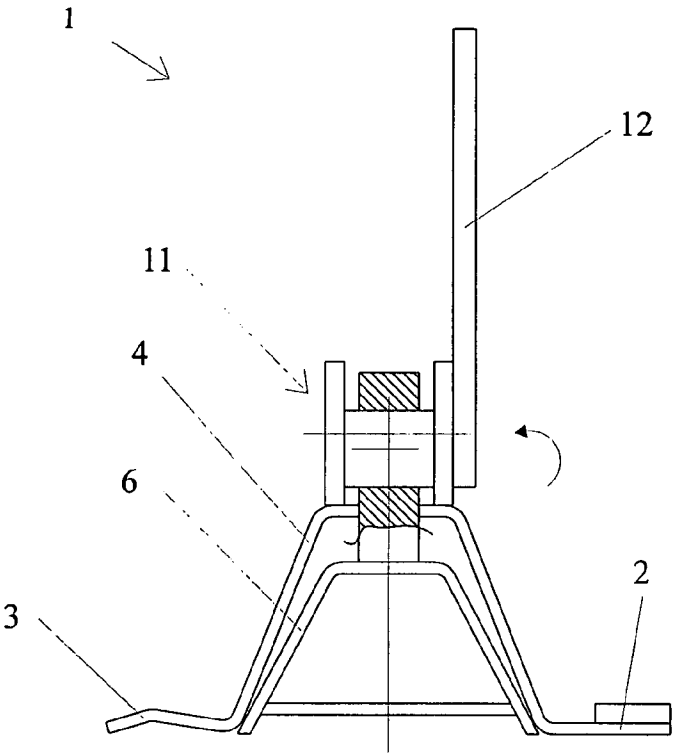

FIG. 1, shows an advantageous embodiment of a clamp unit according to the invention. End portions 2, 3 of a clamp unit 1, and the structure 4 linking the same with each other form a stiff, spring-like body in the interior space of which an intermediate part which is adapted movable by means of a screw 5 and which intermediate part in this embodiment is a wide, wedged piece 6. The shape of the end portions 2, 3 of the clamp unit are made compatible with the rails running along the rear side edges of the side wall beam, and the end portions could also be identical. A compatible shaping of the end portions to fit them into the rear side rails of the beam promotes tight locking or attachement of the clamp unit. The embodiment of the clamp unit illustrated in FIG. 1 is advantageously used for interconnecting side wall beams equipped with rear side profile having grooves.

Figure 2A:
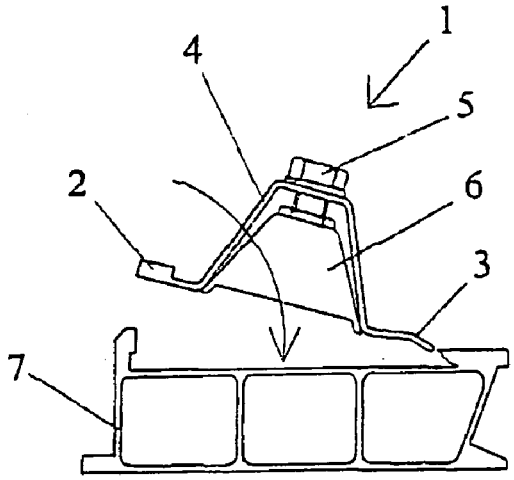
FIGS. 2*a*–2*d* show the placing of a clamp unit according to the invention on a side wall and dismounting the same from the side wall.
Figure 2B:
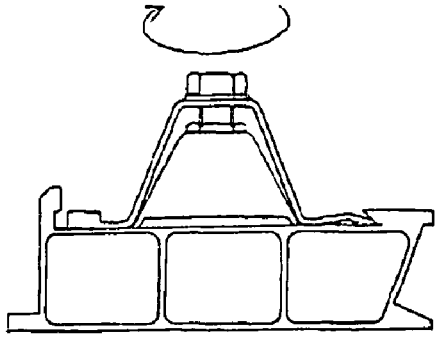
Figure 2C:
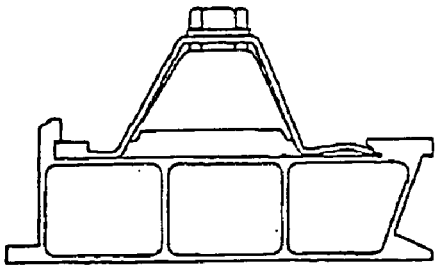
Figure 2D:
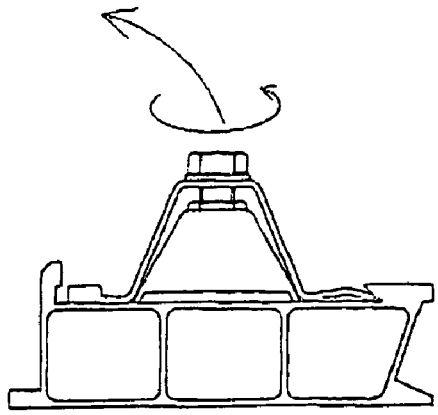

FIGS. 2*a*–2*d* show the placing of a clamp unit 1 according to the invention on a mold side wall beam 7 having its rear side equipped with grooved longitudinal rails and dismounting of the clamp unit from the said side wall beam. When the wedged part 6 is in its lower position (FIG. 2*a*), the distance between the end portions 2, 3 is such that the clamp unit can be inserted between the grooves. Tightening of screw 5 (FIG. 2*b*) causes the structure 4 linking the end portions to become wider under the effect of the wedged part, whereby the distance between the end portions 2, 3 in the plane direction increases thus causing the clamp unit 1 to lock advantageously substantially without any play into the space between the upper and lower edge groove of the mold side wall beam (FIG. 2*c*). At the unwinding of the screw, the wedged part 6 is driven downward whereby the distance between the end portions decreases with the contraction of the structure of the connecting part, advantageously caused by spring-force, whereupon the clamp unit can be released from the locked position between the rail grooves, the clamp unit claws by pulling outwards (FIG. 2*d*).

The embodiment in accordance with FIG. 1 has a wedged member 6 equipped with a thread. The thread may also be located, e.g., in the structure 4 joining the end portions and a wedged member 6 stationarily connected to the screw. Movement of the structure connecting the end portions for adjustment of the distance between the end portions can also be arranged by any other suitable method that is not shown above. The shape and structure of the intermediate part and the structure or portion joining the end portions may, as well, be modified according to the purpose. For instance, the intermediate part may comprise a spring or a screw aligned in the horizontal plane by means of which the distance between the edge portions is adjusted.

Figure 3A:
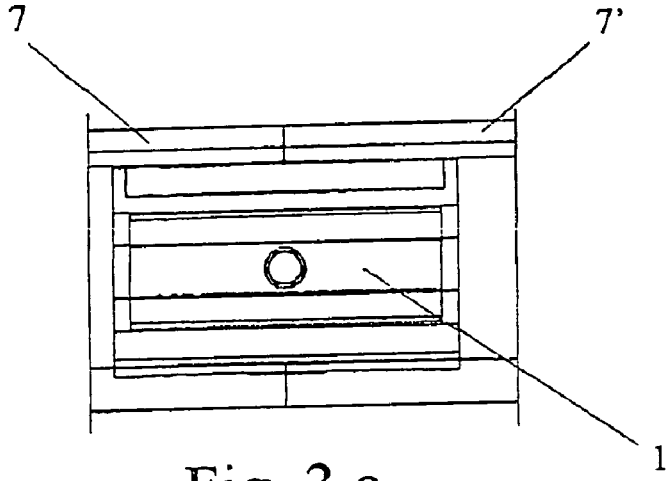
FIGS. 3*a* and 3*b* show a top view and a side elevation view of the connection of two mold side walls into one long side wall and FIG. 3*c* shows a side view of the extension of a basic wall beam with an adapter member using a clamp unit according to the invention.
Figure 3B:
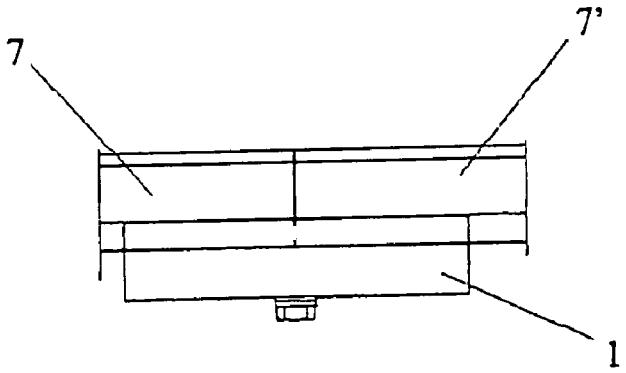
Figure 3C:
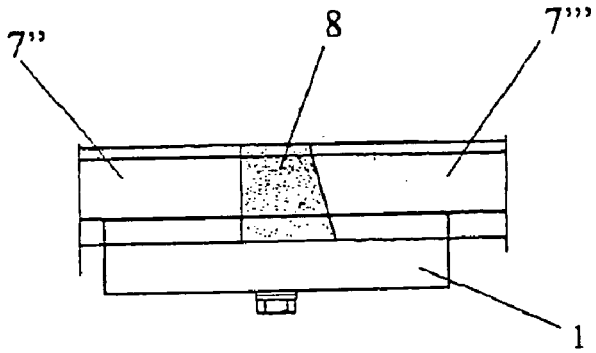

FIGS. 3*a* and 3*b* show a top view and a side elevation view of connection of two side walls 7, 7' into one long side wall, and FIG. 3*c* shows a side elevation view of the extension of basic side wall beam 7', 7''' with an adapter part 8 using a clamp unit 1 according to the invention;

The plate-like shape or structure of the clamp unit illustrated in FIGS. 1–3 promotes the stiffness of the clamp unit, whereby the integrity and stiffness of the joining point of the side wall beams is enhanced. An advantageous shape of the structure 4 joining the end portions 2, 3 and an advantageous shape of the end portions 2,3 shown in FIGS. 1–3 offer improved clamping pressure at the edge regions of the clamp unit.

Figure 4C:
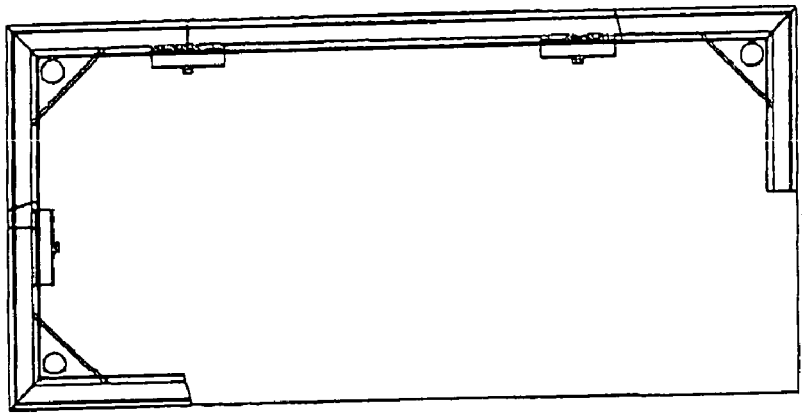
FIGS. 4*a*–4*c* show the steps of dismounting a casting mold for obtaining openings when a clamp unit according to the invention has been used to connect the side wall beams.
Figure 4B:
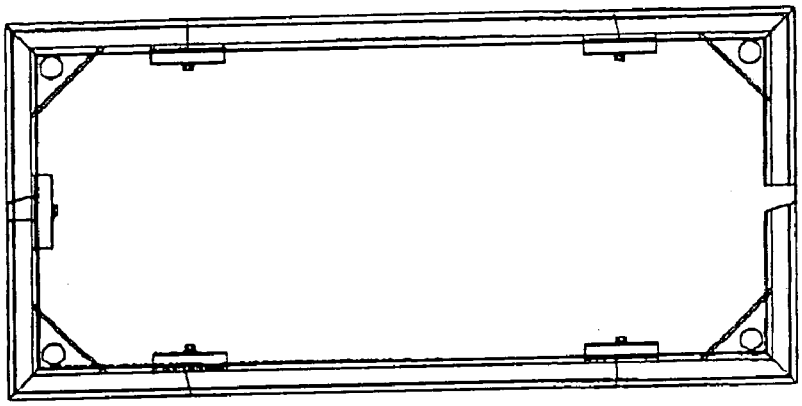
Figure 4A:
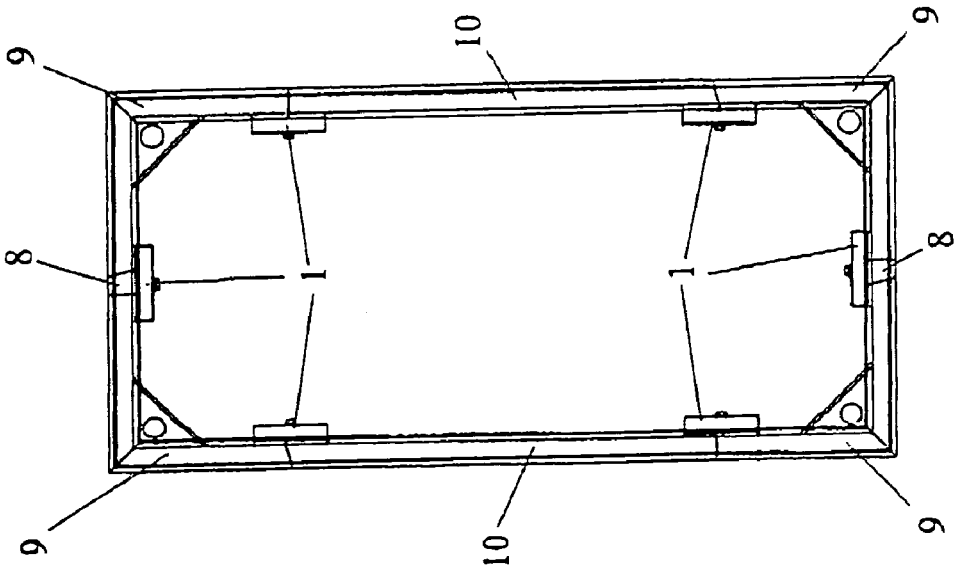

In FIGS. 4*a*–4*c* are shown the steps of dismounting a casting mold for obtaining openings when the mold side wall beams 9, 10 are connected using a preferred embodiment of the clamp unit 1 according to the invention. The dismounting of the casting mold for obtaining openings is advantageously commenced by first unfastening the clamp unit 1 at the small adapter piece and then removing the adapter piece 8. Subsequently, the casting mold for obtaining openings can be dismounted easily and rapidly, and all side wall beams need not be disconnected from each other but some of the clamp units may be left in place.

The clamp unit according to the invention is advantageously made of plastic, metal or a combination thereof.

What is claimed is:

1. A clamp for interconnecting side wall beams of a concrete casting mold, the side wall beams incorporating protruding upper and lower edges, wherein said clamp comprising:

at least two end portions connected to each other; and means for adjusting the distance between said end portions, wherein the at least two end portions releasable lock into a space between the upper and lower edges, wherein said clamp unit end portions are adapted means or at least part of said means for adjusting distance between said end portions, and wherein said means for adjusting distance comprise a wedge-like member and a screw thread.

2. The clamp unit according to claim 1, wherein said clamp unit end portions are joined to each other so that a spring-force is effected for moving the end portions of the said clamp unit closer to or farther away from each other.

3. A clamp unit for interconnecting side wall beams of a concrete casting mold, the side wall beams incorporating protruding upper and lower edges, wherein said clamp unit comprising:

at least two end portions connected to each other; and means for adjusting the distance between said end portions, wherein the at least two end portions releasable lock into a space between the upper and lower edges, wherein said clamp unit end portions are adapted means or at least part of said means for adjusting distance between said end portions, and wherein means for adjusting distance comprise an eccentric cam mechanism and wedge-like member.

4. The clamp unit according to claim 1, comprising means for retaining the distance between the end portions as adjusted.

5. The clamp unit according to claim 2, wherein said clamp unit end portions are adapted means or at least part of said means for adjusting distance between said end portions.

6. The clamp unit according to claim 2, comprising means for retaining the distance between the end portions as adjusted.

7. The clamp unit according to claim 3, comprising means for retaining the distance between the end portions as adjusted.

8. The clamp unit according to claim 4, comprising means for retaining the distance between the end portions as adjusted.

9. The clamp unit according to claim 5, comprising means for retaining the distance between the end portions as adjusted.

10. The clamp unit according to claim 3, wherein said clamp unit end portions are joined to each other so that a spring-force is effected for moving the end portions of the said clamp unit closer to or farther away from each other.

* * * * *